US005368360A

United States Patent [19]

Groh

[11] Patent Number: 5,368,360

[45] Date of Patent: Nov. 29, 1994

[54] COVER PIECE FOR SEAT MEMBER OF BLEACHER SEAT UNIT

[75] Inventor: A. Anthony Groh, Columbus, Ohio

[73] Assignee: Crane Plastics Company, Columbus, Ohio

[21] Appl. No.: 786,853

[22] Filed: Nov. 1, 1991

[51] Int. Cl.[5] ..... A47C 27/00

[52] U.S. Cl. ..... 297/219.1; 108/90

[58] Field of Search ..... 108/90; 297/218, 219, 297/184

[56] References Cited

U.S. PATENT DOCUMENTS

| | | | |
|---|---|---|---|
| 2,556,943 | 6/1951 | Reisman | 108/90 |
| 4,227,467 | 10/1980 | Kindsfather | 108/90 X |
| 5,070,664 | 12/1991 | Groh et al. | 297/218 X |

FOREIGN PATENT DOCUMENTS

| | | | |
|---|---|---|---|
| 642491 | 5/1964 | Belgium | 108/90 |
| 940286 | 12/1948 | France | 108/90 |
| 894897 | 4/1962 | United Kingdom | 297/218 |

OTHER PUBLICATIONS

Crane Plastics Brochure.

*Primary Examiner*—Jose V. Chen

*Attorney, Agent, or Firm*—Standley & Gilcrest

[57] ABSTRACT

A bleacher seat cover and a bleacher seat containing same are disclosed. The bleacher seat cover is of a resilient polymeric material such as an extruded thermoplastic material. The profile of the bleacher seat cover is formed such that the profile of the cover can be distorted from its original shape to a tensed shape, to allow it to be slid over a bleacher seat. Once released from the tensed shape, the resilience of the cover allows it to exert a spring static force against the side(s) and bottom of the bleacher seat to hold the cover in place. In a preferred embodiment, the cover member has a profile that defines a figure wherein the top portion is represented by a straight line; each side portion is represented by a straight line extending at least ninety degrees therefrom; and each bottom portion is represented by a straight line extending at less than ninety degrees from the side from which it extends.

20 Claims, 2 Drawing Sheets

COVER PIECE FOR SEAT MEMBER OF BLEACHER SEAT UNIT

BACKGROUND

The present invention relates to a cover piece for the seat member of a bleacher seat unit. Such cover pieces can be used on outdoor or indoor bleacher seat units such as those found in gymnasiums, sports arenas and fields, outdoor and indoor swimming pools and similar spectator facilities. The invention can also be used on telescoping bleacher seat units such as those normally found in indoor settings.

Although many of the more modern bleacher seat units are made with plastic seat members, wood has been and continues to be used in the construction of bleacher seat units, including the seat member portion. Because the seat portions of the units must be long and straight, it is necessary to use select cuts of wood, such as dense, tough Southern Pine. Also, for increased longevity and durability, the wood must be treated to resist scratching, scuffing and staining. From the standpoint of appearance, original manufacturers generally prefer cuts of wood which do not contain unattractive artifacts, such as knotholes, unsightly grain lines, etc. This causes manufacturers to reject otherwise structurally suitable cuts of wood, with rejection rates commonly reaching as high as thirty percent.

Because bleacher seat units are generally prepared as complete assemblies, it is often difficult and expensive to replace individual seat portions as they become worn through normal use, or abuse.

More modern bleacher seat units that use specially manufactured plastic seat portions are commercially available. However, it is not economically feasible to retrofit the all wooden units with the more durable plastic seating.

Accordingly, it is desirable to provide the benefits of cover pieces to seat portions of bleacher seat units which presently use wooden seat portions, whether at the point of original manufacture or as a retrofit item. These benefits include greater durability, greater stain and marring resistance, and greater slip resistance, with reduced danger from splintering or cracking. Another benefit to the original manufacturer is that wood cuts that would ordinarily be rejected as unattractive can be used. Likewise, it is also desirable to be able to use other building materials in bleacher seats which otherwise would be unacceptable. One example of such a material is aluminum which in sheet form is very uncomfortable for seating.

Another problem posed by many telescoping bleacher seat units is that their complex construction makes them difficult to retrofit with plastic overlays. This is particularly true in bleacher seat assemblies that have facing, vertical kick panels which are attached so as to reside in close proximity to and descending from the front edge of the seat portion members. It is therefore difficult to provide a plastic sheathing for the seat portion which will completely clad the wood seat member in situ. Accordingly, it is desireable to produce a plastic seat cover which will allow one to cover the seat portion of a bleacher seat unit without requiring special tools or disassembly of the seat portions from the bleacher seat unit.

The foregoing objectives and advantages are provided by the present invention. Other advantages and the solutions to other problems may become apparent to one of ordinary skill in light of the present disclosure.

SUMMARY OF THE INVENTION

Toward achieving the above objectives and advantages, the present invention relates to a cover piece for the seat portion of a bleacher seat unit, and to a bleacher seat unit having a plurality of seat members having at least one of its seat members provided with a cover piece of the present invention. In its most general form, the cover piece comprises a polymeric material, such as a polymeric extrudate, which extends longitudinally and laterally to cover the top of the seat member. The cover piece of the present invention also has side portions which are adapted to cover the top surface of the seat member, and grasp at least one the side portions of the seat member and/or to grasp at least a portion of the underside of the seat member. The principal functions of the present invention are to provide a comfortable, protective covering to the seat member and to have the cover piece resist sliding from its position on the seat member without the need for additional affixation means ( such as bolts, nails, screws, etc. ).

The cover piece of the present invention can be most generally described as a resilient polymeric member, having an original shape, and comprising a substantially flat top portion adapted to be substantially coextensive with said top surface of said seat member, and two lip portions appended to said top portion; wherein said polymeric member is sufficiently resilient so that it may be flexed from said original shape to a tensed shape wherein said lip portions engage said two side surfaces and said bottom surface so as to exert a static force upon at least one of said two side surfaces and said bottom surface. The present invention in its broadest form is not limited to any particular geometry of the lip portions, which may comprise any arrangement of straight and/or curved sections so long as they perform the function of the present invention.

As one example of such a geometry, the cover piece, in its original shape, is made to appear, in cross section to approximate a figure which can be colloquially described as that of a closed staple, as will be more precisely defined and shown in the figures herein.

The polymeric material used in this example of the cover piece of the present invention, and its thickness, are selected to provide the cover piece with a sufficient amount of resilience so that the cover piece can be moved from its original shape to a tensed shape wherein it assumes a substantially rectangular configuration (that is, the angles between its individual portion segments become approximately 90 degrees). This allows the cover piece to be placed over the seat member, and the resilience of the cover piece causes static forces to be applied to the side surfaces and underside surfaces of the seat member, to hold the cover piece in place.

The cover piece may be made to fit closely about any size seat member.

The polymeric material which may be used in the present invention can be selected from the group of any polymeric materials known in the art. It is preferred that such polymeric materials be selected from the group consisting of thermoplastic materials such as polyvinylchlorides, polyethylenes, ABS plastics, and styrenes; with appropriate strength and resilience characteristics. In this regard, it is most preferred that the plastic chosen in part a sufficient amount of resilience to the cover piece to allow the cover piece to be relatively easily flexed to fit over the seat member, and with sufficient resilience that, once placed over the seat member, the cover piece, by attempting to return to its original form, imparts a static force against the sides and/or the under side of the seat member to hold the cover piece in place.

As will be more fully described below, in a preferred embodiment, the cover piece of the present invention comprises a top portion which is dimensioned to be coextensive with the top portion of the seat member to be covered. Descending from the top portion on either side are side portions which are at an angle less than 90 degrees to the top portion. The side portions are dimensioned to be coextensive with the sides of the seat member. Extending from the side portions are lip portions which are disposed at an angle of less than 90 degrees to their respective side portion. It is preferred that the aforementioned angles of less than 90 degrees be in the range of from about 75 to about 89 degrees, and such angle will vary depending on the degree of stiffness and resilience of the polymeric material utilized. Typically, the dimensions for the top, side and lip portions are 9.5 inches, 1.00 inches and 0.75 inches, respectively.

Any portions of the cover piece which will be exposed during its use (generally the top and side portions) may be textured or embossed to improve its appearance and/or comfort in seating, such as to provide slide resistance.

DETAIL DESCRIPTION OF THE PREFERRED EMBODIMENT

In accordance with the foregoing summary of the invention, the following presents a preferred embodiment of the invention which is presently considered to be the best mode of the invention.

Figure 1:
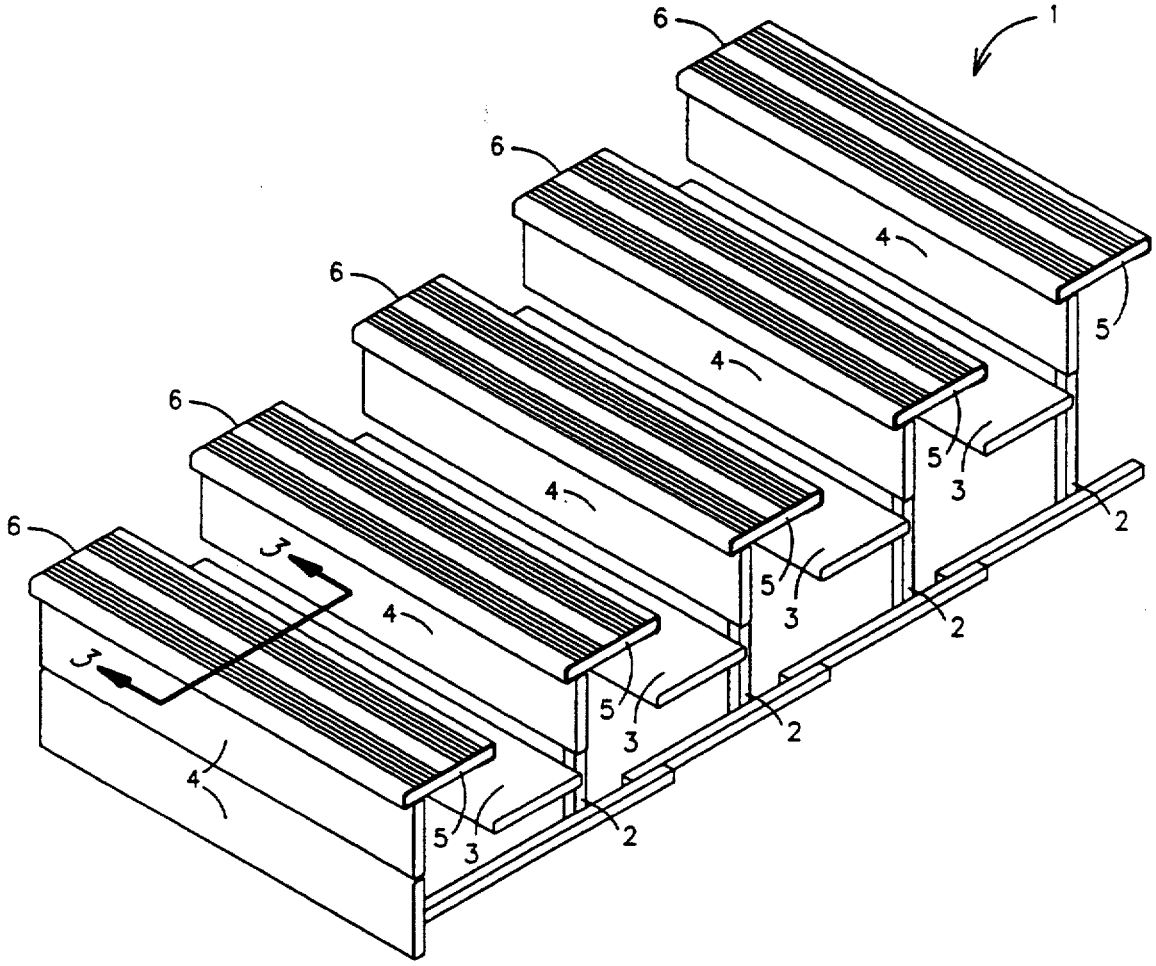
FIG. 1 is a sectioned environmental view of a telescoping bleacher seat unit in its extended configuration, and showing the cover piece of the present invention in use.

Turning first to FIG. 1, this figure shows an environmental view of a telescoping bleacher seat unit 1 in its extended configuration as it would be placed for seating. The bleacher seat unit 1 comprises frame work pieces 2 (generally made of metal), foot rest pieces 3 and kick panel pieces 4. Also shown are seat members 5 which are shown covered with the cover piece 6 of the present invention.

Figure 2:
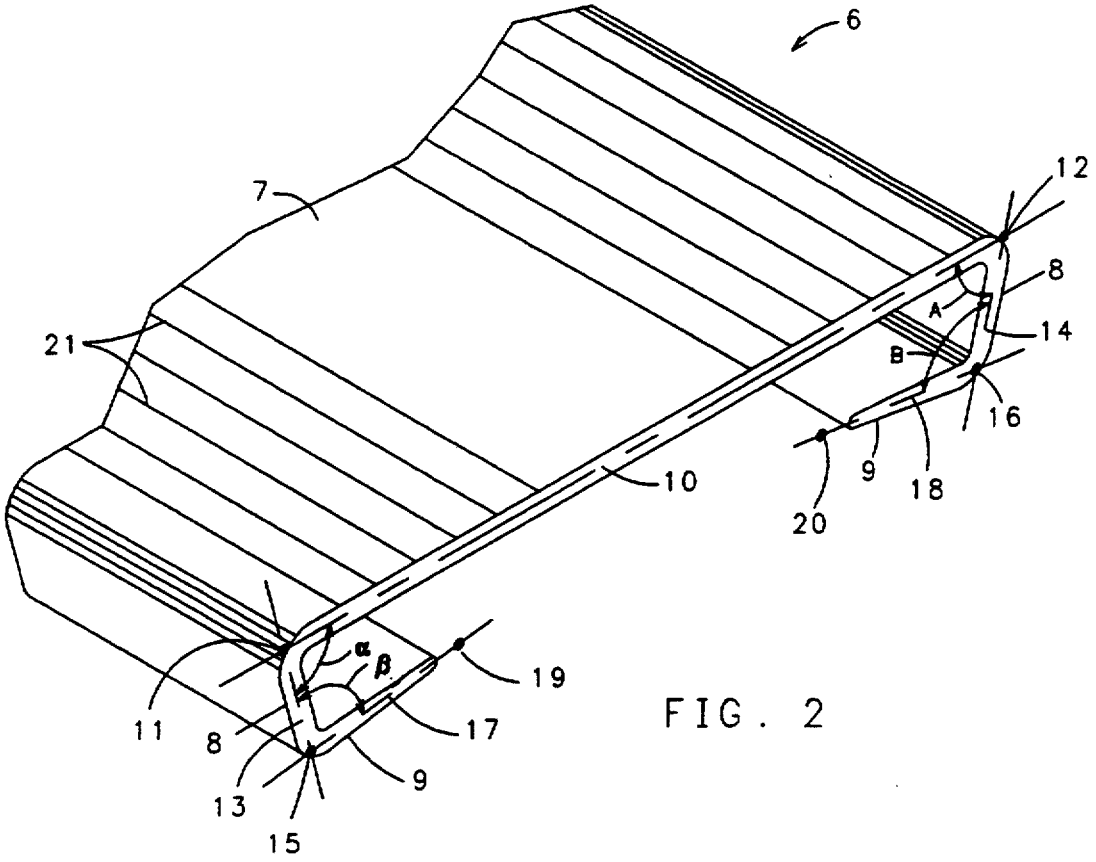
FIG. 2 is a sectioned, angled perspective view showing a section of a cover piece in accordance with one embodiment of the present invention.

FIG. 2 is a sectioned, angled perspective view of a section of a cover piece 6 in accordance with embodiment of the present invention. Cover piece 6 can be generally described as having top portion 7, side portions 8, each of the side portions 8 descending from the top portion 7 at a first angle alpha which is less than 90 degrees. Each side portion 8 has respectively a lip portion 9 which extends inwardly at an angle data, less than 90 degrees.

The shape of the cover piece of the present invention defines, in cross-section, approximately a figure comprising; (a) a substantially straight line segment 10 having two first end-points 11 and 12; (b) a second line segment extending from each of said to end points (segment 13 extending from end point 11 and segment 14 extending from end point 12 at a first angle alpha of less than 90 degrees to the first line segment 10, the second line segments 13 and 14 having two end points 15 and 16, respectively; and (c) a third line segment extending from each of said second end points of said second line segments to a third end point (i.e., third line segment 17 extending to end point 19 and third line segment 18 extending to endpoint 20), at a second angle beta less than 90 degrees to said respective second line segments (i.e., segments 13 and 14 respectively).

In the embodiment of the present invention shown in FIG. 2, angle alpha is approximately 75 degrees, and angle beta is approximately 80 degrees.

In the preferred embodiment of the present invention, it is preferred that the thickness of the third line segments 17 and 18 be tapered downward in thickness from points 15–19 and points 16–20, respectively. This allows the cover piece to be easily slipped into position over the seat member as shown in FIG. 3.

In an alternative embodiment, the portions corresponding to the second and third line segments may be replaced with a continuous curved portion which likewise is adapted to engage and grasp the side and bottom portions of the seat member.

The exposed portions of top portion 7 and side portion 8 may preferably be embossed or textured to provide a more attractive appearance and or to provide more comfortable seating. This is shown for instance as ribbing 21.

Figure 3:
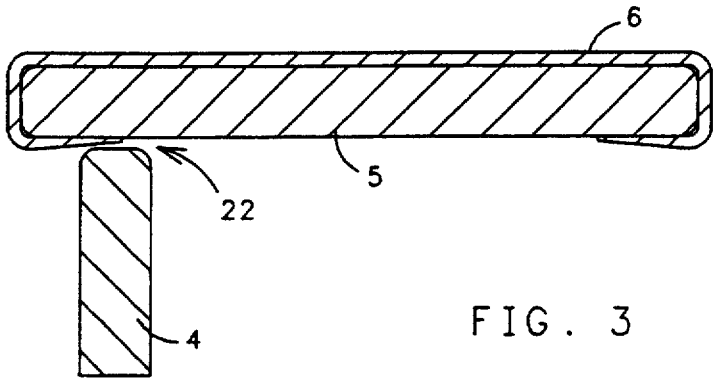
FIG. 3 is a section of view along line 3—3 showing a cover piece in accordance with one embodiment of the present invention covering a seat member of a bleacher seat unit.

FIG. 3 is a cross-section view along line 3—3 of FIG. 1. This figure shows cover piece in position over seat member 5, and shows the normally close spacing between seat member and kick panel piece 4.

As can be seen in FIG. 3, the cover piece of the present invention is made of a polymeric material of sufficient thickness so as to be sufficiently flexibly resilient to allow cover piece 6 to be moved from its original shape. (shown in FIG. 2) to a substantially more rectangular shape as can be seen in FIG. 3. In this second or "tensed" shape, the cover piece of the present invention has been deformed so that the side portions 8 and lip portions 9 have been flexed to a position such that angles alpha and beta are approximately 90 degrees to fit over the seat member 5. The stiff resilience of the polymeric material is such that the cover piece, in attempting to return to its original shape, in imparts static forces against the side of the seat member 5, by virtue of lip portions 8 pushing inwardly substantially perpendicular to their inner faces (i.e. substantially perpendicular to the position line segments 13 and 14 would assume when angle alpha become 90 degrees). In like fashion, lip portions 9 pushes upwardly against the underside of seat member 5 (i.e. substantially perpendicular to the position line segments 17 and 18 would assume when angle beta becomes approximately 90 degrees).

FIG. 3 also shows that the tapering of lip portions 9 aid in allowing cover piece 6 to be positioned over seat member 5, notwithstanding the close proximity of kick panel piece 4. The tapering of lip portions 9 allow them to be more easily positioned between seat member 5 and kick panel piece 4 in gap 22.

It is preferred that the cover piece of the present invention be formed as a polymeric extrudate, as this is thought to be the most efficient way to produce the desired shape. In the embodiment shown here, the thickness of the top portion 7 and the side portions 8 are preferably about two millimeters and the lip portion tapered in thickness from two millimeters to less than one millimeter, when the polymeric material used is polyvinylchloride.

It will be noted that the top, side and lip portions shown in FIG. 2 are actually joined at rounded junctions rather than sharp corners. It is preferred that the junctions be rounded to improve the comfort of the resulting covered seat member shown in FIG. 3, as well as to improve its strength characteristics and ease of manufacturer. It should therefore be understood that this embodiment of the present invention is not limited by any shape or configuration beyond the general geometric description given above.

It is preferred that the cover piece of the present invention be prepared as the extrudate of a thermoplastic material. Such an extrudate may be made using extruder machines and apparatus commonly known and used in the plastics art such as Models CM-65, CM-80 or CM-111, commercially available from Cincinnati Milacron of Cincinnati, Ohio; Model GC-8, commercially available from Davis Standard Company, or equivalent apparatus.

In view of the foregoing disclosure, it will be obvious to one of ordinary skill in the art to make modifications or alterations, or to substitute equivalents, to or in the present invention without affecting the function, manner of function, or result of the present invention. Such modifications may include, for instance, the use of alternative geometries, alternative materials, etc.

What is claimed is:

1. A cover piece for a seat member of a bleacher seat unit, said cover piece comprising:

a resilient member comprising a polymeric material, said member having an original shape which, in cross-section defines a figure comprising:

(a) a substantially straight first line segment having two first end points;

(b) a second line segment extending from each of said first two end points to one side of said first line segment and at a first angle of less than 90 degrees to said first line segment, said second line segments each having a second endpoint; and (c) a third line segment extending from each of said second end points of said of second line segments to a third end point and at a second angle less than 90 degrees to said second line segment and toward said first line segment.

2. A cover piece according to claim 1 wherein said first angle is in the range of from about 70 to about 89 degrees and wherein said second angle is in the range of from about 70 to 89 degrees.

3. A bleacher seat unit having a plurality of seat members, wherein at least one of said seat members is provided with a cover piece according to claim 2.

4. A cover piece according to claim 1 wherein the portions of said cover piece corresponding to said third line segments in said cross-section are tapered in decreasing thickness from said second end point toward said third end point.

5. A bleacher seat unit having a plurality of seat members, wherein at least one of said seat members is provided with a cover piece according to claim 4.

6. A cover piece according to claim 1 wherein said cover piece is sufficiently resilient so as to be flexible from said original shape to a tensed shape so as to engage said seat member and wherein said first angle becomes about 90 degrees and whereby said cover piece directs a static force substantially perpendicular to the portions of said cover piece corresponding to said second line segments when said cover piece is in said tensed shaped, against said seat member.

7. A bleacher seat unit having a plurality of seat members, wherein at least one of said seat members is provided with a cover piece according to claim 6.

8. A cover piece according to claim 1 wherein said cover piece is sufficiently resilient so as to be flexible from said original shape to a tensed shape so as to engage said seat member and wherein said second angle becomes about 90 degrees and whereby said cover piece directs a static force substantially perpendicular to the portions of said cover piece corresponding to said third line segments when said cover piece is in said tensed shape, against said seat member.

9. A bleacher seat unit having a plurality of seat members, wherein at least one of said seat members is provided with a cover piece according to claim 8.

10. A cover piece according to claim 1 wherein said cover piece is an extrudate of a thermoplastic polymeric material.

11. A bleacher seat unit having a plurality of seat members, wherein at least one of said seat members is provided with a cover piece according to claim 10.

12. A cover piece according to claim 10 wherein said polymeric member is selected from the group consisting of polyvinylchlorides, polyethylenes, ABS plastics, and styrenes.

13. A bleacher seat unit having a plurality of seat members, wherein at least one of said seat members is provided with a cover piece according to claim 12.

14. A cover piece according to claim 1 wherein the thickness of the portions of said cover piece corresponding to said first line segment and said second line segments have a thickness in the range of from about 1 millimeters to about 10 millimeters.

15. A bleacher seat unit having a plurality of seat members, wherein at least one of said seat members is provided with a cover piece according to claim 14.

16. A cover piece according to claim 1 wherein said cover piece is an extrudate of a polymeric material comprising polyvinylchloride and wherein the thickness of the portions of said cover piece corresponding to said first line segment and said second line segments is in the range of from about 1 millimeter to about 3 millimeters when said polymeric material is polyvinylchloride.

17. A bleacher seat unit having a plurality of seat members, wherein at least one of said seat members is provided with a cover piece according to claim 16.

18. A bleacher seat unit having a plurality of seat members, wherein at least one of said seat members is provided with a cover piece according to claim 1.

19. A cover piece and a seat member for a bleacher seat unit, said cover piece and seat member comprising:

(a) a seat member having a top surface, two side surfaces and a bottom surface; and (b) a cover piece comprising a polymeric material, said piece having an original shape, said piece comprising:

(i) a substantially flat top portion adapted to be substantially coextensive with said top surface of said seat member, and (ii) two lip portions appended to said top portion;

wherein said cover piece is sufficiently resilient so that it may be flexed from said original shape to a tensed shape and wherein said cover member has been flexed from said original shape to a tensed shape and placed over said seat member, and, then released from said tensed shape so as to form a relatively less tensed shape, whereby said at least one of said lip portions engages said bottom surface and at least one of said two side surfaces such that said cover member exerts a spring static force upon at least one of said two side surfaces and said bottom surface.

20. The cover piece and seat member according to claim 19 wherein said top surface of said seat member is substantially flat and wherein said side surfaces of said seat member are substantially flat and substantially perpendicular to said top surface; and wherein, once released from said tensed shape so as to form said relatively less tensed shape, said top portion of said cover piece is substantially flat and said lip portions of said cover piece are substantially flat and substantially perpendicular to said top portion.

* * * * *

UNITED STATES PATENT AND TRADEMARK OFFICE

CERTIFICATE OF CORRECTION

PATENT NO. : 5,368,360

DATED : November 29, 1994

INVENTOR(S) : A. Anthony Groh

It is certified that error appears in the above-indentified patent and that said Letters Patent is hereby corrected as shown below:

In column 4, line 34, after the word "piece", please insert -- 6 --.

In column 4, line 36, after the word "member", please insert -- 5 --.

In column 4, line 41, after the word "shape", please delete -- . --.

Signed and Sealed this

Fourteenth Day of March, 1995

Bruce Lehman

*Attest:*

BRUCE LEHMAN

*Attesting Officer*

*Commissioner of Patents and Trademarks*